343-700 MS AU 251 EX
10/2/84 OR 4,475,107

United States Patent [19]
Makimoto et al.

[11] Patent Number: 4,475,107
[45] Date of Patent: Oct. 2, 1984

[54] CIRCULARLY POLARIZED MICROSTRIP LINE ANTENNA

[76] Inventors: Toshio Makimoto, 15-3, Shinsenrinishimachi 2-chome, Toyonaka-shi, Osaka; Sadahiko Nishimura, 3-25, Tamatsukurimotomachi, Tennoji-ku, Osaka, both of Japan

[21] Appl. No.: 328,441

[22] Filed: Dec. 7, 1981

[30] Foreign Application Priority Data

Dec. 12, 1980 [JP] Japan ..... 55-176443

[51] Int. Cl.[3] ..... H01Q 1/38
[52] U.S. Cl. ..... 343/700 MS; 343/846
[58] Field of Search ..... 343/700 MS, 846, 829, 343/731, 830, 853, 806

[56] References Cited

U.S. PATENT DOCUMENTS

| | | | |
|---|---|---|---|
| 3,643,262 | 2/1972 | Dumanchin | 343/700 MS |
| 4,021,810 | 5/1977 | Urpo et al. | 343/846 |
| 4,160,976 | 7/1979 | Conroy | 343/700 MS |
| 4,238,798 | 12/1980 | Aitken et al. | 343/700 MS |
| 4,335,385 | 6/1982 | Hall | 343/700 MS |

FOREIGN PATENT DOCUMENTS

| | | | |
|---|---|---|---|
| 53904 | 4/1980 | Japan | 343/700 MS |

OTHER PUBLICATIONS

Henriksson et al., "A Circularly Polarized Traveling-Wave Chain Antenna", Microwave, 17-20, Sep. 1979, (pp. 174-178).

*Primary Examiner*—Eli Lieberman
*Assistant Examiner*—Michael C. Wimer
*Attorney, Agent, or Firm*—Wenderoth, Lind & Ponack

[57] ABSTRACT

A circularly polarized microstrip line antenna has a dielectric substrate having a ground plate formed on one surface thereof and at least a pair of stripline conductors on the other surface. Each stripline conductor consists of a plurality of crank type fundamental elements, each element consists of a pair of straight portions each having a length a, and U-shaped portion consisting of a pair of arm pieces, each having a length b, and a single base piece having a length c. The lengths a, b and c are chosen to satisfy the following equations:

$$0 < b \leqq \tfrac{1}{2}\lambda g$$

where λg is a guide wavelength, $$2a = \{(-n - m \mp T)\lambda g - b\}/(1 - \eta \cos \theta m)$$

where
m and n are integers, $$T = 1/\pi \ \mathrm{Tan}^{-1}\{\sin \theta m/(1 - \eta \cos \theta m)\}$$

$$\eta = \lambda g/\lambda_0$$

where
θm is an angle of main beam direction, η is the effective wavelength reduction rate and, $\lambda_0$ is free space wavelength and:

$$C = \}(m \pm T)\lambda g - b\}/(1 - \eta \cos \theta m)$$

optimally, $b = \frac{3}{8}\lambda g$.

6 Claims, 22 Drawing Figures

λg/4 + 2Δℓ
G
Δℓ
λg
λg
λg
2λg
λg/4
λg/2
3/4 λg
3/4 λg
λg
Δℓ
F

Δℓ
G
λg
λg
3/2 λg
2λg
λg/4
λg/2
3/4 λg
λg/4
Δℓ
F

CIRCULARLY POLARIZED MICROSTRIP LINE ANTENNA

BACKGROUND OF THE INVENTION

1. Field of the Invention

The present invention relates to a microstrip line antenna, and more specifically, to a novel construction of a circularly polarized microstrip line antenna.

2. Description of the Prior Art

Conventionally, there has been presented a circularly polarized microstrip line antenna of a type as shown in FIG. 1, which is of a travelling-wave antenna including a dielectric substrate 1, a ground plate 2 uniformly formed on the reverse surface of the dielectric substrate 1, and a strip conductor 3 formed by periodical folding or bending so as to be further provided thereon as shown, and which has already been proposed by the present inventors.

However, since the known antennas of the above described type are all travelling-wave antennas which are each formed by periodically folding a single continuous strip conductor, upon variation of the frequency so as to be higher or lower than the working central frequency, the main beam direction scans along the longitudinal direction of the dielectric base plate 1. Therefore, in the application to the transmission or reception with respect to one predetermined direction, there is such a disadvantage that the frequency band-width is undesirably limited upon the consideration of the influence caused by the scanning.

It is an object of the present invention to provide an improved circularly polarized microstrip line antenna of a new type.

SUMMARY OF THE INVENTION

To accomplish the foregoing objectives, there is provided an improved microstrip line antenna which comprises a dielectric substrate having a ground plate formed on one surface thereof and at least a pair of stripline conductors bent periodically on the other surface to be applied a travelling-wave. Each stripline conductor consists of a plurality of crank type fundamental elements, each element consists of a pair of straight portions each having a length a, and U-shaped portion consisting of a pair of arm pieces each having a length b, and a single base having a length c, the straight portions of each stripline conductor are aligned in a imaginary straight line, and the elements are aligned so that the U-shaped portions are in a same orientation. The lengths a, b and c are chosen to satisfy the following equations.

$$0<b\leqq\tfrac{1}{2}\lambda g$$

where λg is a guide wavelength, $$2a=\{(-n-m\mp T)\lambda g-b\}/(1-\eta\cos\theta m)$$

where m and n are integers, $$T=1/\pi\ \mathrm{Tan}^{-1}\{\sin\theta m/(1-\eta\cos\theta m)\}$$

$$\eta=\lambda g/\lambda_0$$

where

θm is an angle of main beam direction, η is effective wavelength reduction rate, $\lambda_0$ is free space wavelength and $$C=\{(m\pm T)\lambda g-b\}/(1-\eta\cos\theta m).$$

Optimally, $b=\frac{3}{8}\lambda g$

According to the present invention, the circularly polarized antenna may be formed on a flat plate, and moreover, antennas having frequency band widths broader than those of the conventional circularly polarized microstrip line antennas may be advantageously obtained.

Furthermore, since the circularly polarized microstrip line antenna according to the present invention is of a circularly polarized antenna showing the one side face radiation field pattern, and may be manufactured through the employment of the photoetching technique on the dielectric substrate, there are various advantages in that it has a reduced thickness and is light in weight, with a remarkable reduction in cost.

BRIEF DESCRIPTION OF THE DRAWINGS

A detailed description of the invention will be made with reference to the accompanying drawings wherein like numerals designate corresponding parts in the figures.

DETAILED DESCRIPTION OF THE PREFERRED EMBODIMENT

The following detailed description is of the best presently contemplated mode of carrying out the invention. This description is not to be taken in a limited sense, but is merely for the purpose of illustrating the general principles of the invention since the scope of the invention is best defined by appended claims.

The present invention relates to a microstrip line antenna, and more specifically, to a novel construction of a circularly polarized microstrip line antenna.

Figure 1:
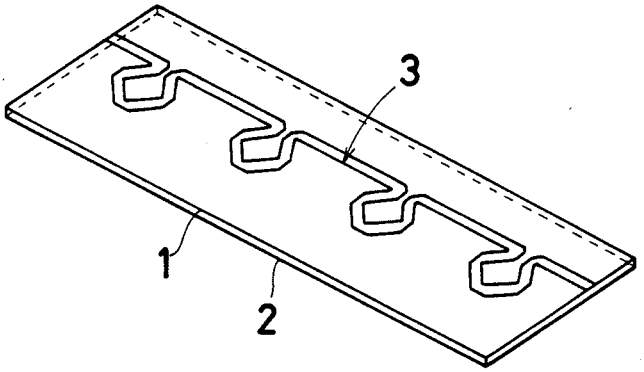
Fig. 1 Prior Art
FIG. 1 is a schematic perspective view showing the construction of a conventional circularly polarized microstrip line antenna.
Figure 2:
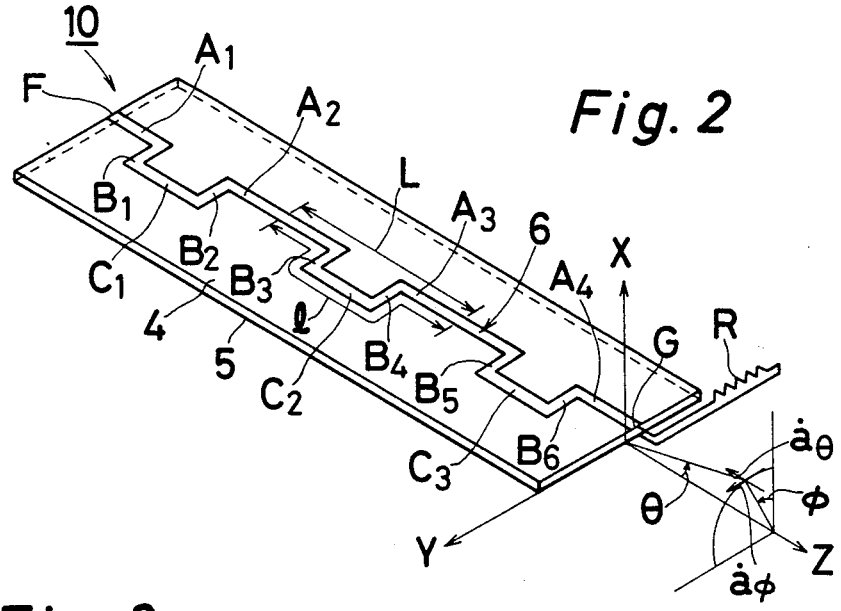
FIG. 2 is a schematic perspective view showing a circularly-polarized microstrip line antenna according to one preferred embodiment of the present invention, together with the co-ordinate system thereof.

Referring first to FIG. 2 there is shown a circularly polarized microstrip line antenna according to one preferred embodiment of the present invention, which generally includes a substrate 4 made of a dielectric material of a flat plate-like configuration with a suitable thickness, a ground plate 5 provided over the entire reverse surface of said substrate 4, and a strip conductor 6 formed by a single line of conductor and provided on the upper surface of said substrate 4. The strip conductor 6 as described above is of a zigzag construction extending in the zigzag manner, and is so arranged that straight or linear pieces and U-shaped portions (each formed by a folded line including opposite arm pieces and a base) having predetermined dimensions are alternately connected to each other in a plurality of sets (the number of sets may arbitrarily be determined), with all of said straight pieces being formed on one straight line (Z direction), while said U-shaped portions are adapted to be located at one side of said one straight line. Accordingly, the strip conductor 6 comprises the Z direction sides $A_1$ to $A_4$ (to be collectively represented as "A"), and $C_1$ to $C_3$ (to be collectively represented as "C"), and Y direction sides $B_1$ to $B_6$ (to be collectively represented by "B"), with lengths of the respective sides being selected in principle to be of predetermined dimensions described later. Meanwhile, as shown in FIG. 2, one end F of the opposite ends of the substrate 4 in the longitudinal direction thereof is adapted to be a feedpoint end, while a matched load R for matching a line impedance (50Ω) solely determined by the dimensions of the strip conductor 6 is connected to the other end G.

Figure 3:
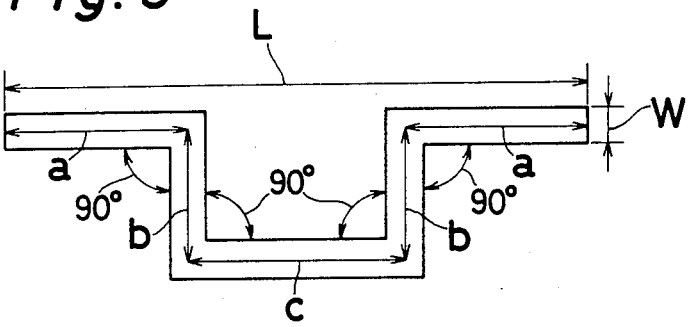
FIG. 3 is a top plan view showing, on an enlarged scale, the construction of a strip conductor employed in the embodiment of FIG. 2.

Of the periodic structure of the strip conductor as shown in FIG. 2, the fundamental structure thereof is shown in FIG. 3. This fundamental structure will be referred to as a crank type fundamental structure in this case, and the circularly polarized radiation characteristics thereof will be subjected to theoretical calculation hereinbelow.

Figure 4:
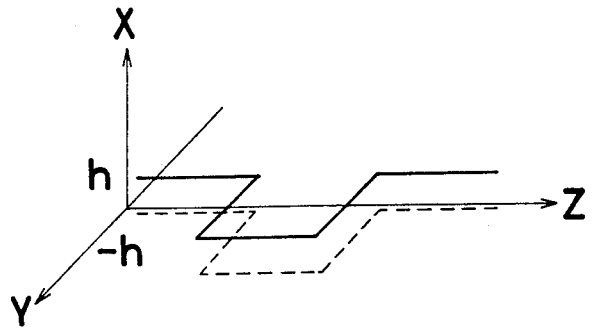
FIG. 4 is a diagram explanatory of the relationship between the strip conductor and image strip conductor.

Now, on the assumption that the size of the crank type fundamental element is infinitely fine, with supposition of a current source flowing a uniform travelling-wave current therethrough, the radiation field at an infinity point will be derived. Firstly, as shown in FIG. 4, the co-ordinate system is determined so that the ground plate is within the YZ plane, in which the symbol h denotes the height from the ground plate to the strip conductor, while an image strip conductor on the assumption that the ground plate is of an infinite size is shown by dotted lines at a height −h. In the present case, the medium in the vicinity of both strip conductors is assumed to be of air, and the contribution by the dielectric constant of the dielectric substrate will be included in the guide wavelength λg subjected to wavelength reduction for treatment. Here, when the far field due to the contribution by the strip conductor is represented by $E_1$, and the far field due to the contribution by the image strip conductor is denoted by $E_2$, the resultant field E of the both will be represented by $$\begin{aligned} E &= E_1 + E_2 \\ &= E_0(e^{jkh\sin\theta\cos\phi} - e^{-jkh\sin\theta\cos\phi}) \\ &= j2E_0\sin(kh\sin\theta\cos\phi) \doteq j2khE_0\sin\theta\cos\phi \\ kh &<< 1 \end{aligned} \tag{1}$$

where $k=2\pi/\lambda_0$, and $\lambda_0$ is the free space wavelength.

Subsequently, the far field Eo in the case where the crank type fundamental element is located in the YZ plane will be obtained. On the assumption that the spherical co-ordinates of the crank type fundamental element are (r', α, π/2), the far field is calculated by the point P (r, θ, φ). Now, when the current density of the crank type fundamental element is represented by $\dot{J}$, the electric vector potential $\dot{A}$ at an infinite distance will be generally represented by $$\dot{A} = \frac{\mu e^{-jkr}}{4\pi r} \int_{v'} \dot{J}(\dot{r}')e^{jkr'\cos\S}\, dv' \tag{2}$$

where μ is the permeability: For the symbol for the far field during the calculations, the radiation vector $\dot{N}$ will be defined as follows:

$$\dot{N} = \int_{v'} \dot{J}(\dot{r}')e^{jkr'\cos\S}\, dv' \tag{3}$$

Therefore, the relationship will be:

$$\dot{A} = \frac{\mu e^{-jkr}}{4\pi r} \dot{N} \tag{4}$$

On the assumption that the unit vectors in the x, y and z directions are respectively denoted by $\dot{a}_x$, $\dot{a}_y$ and $\dot{a}_z$, the unit vector $\dot{a}_r$ in the direction of the observation point will be represented by the equation:

$$\dot{a}_r = \dot{a}_x \sin\theta\cos\phi + \dot{a}_y \sin\theta\sin\phi + \dot{a}_z\cos\theta \tag{5}$$

On the other hand, vector r' from the original point O to the wave source on the crank type fundamental element will be given by:

$$\dot{r}' = \dot{a}_y y' \sin\alpha + \dot{a}_z z' \cos\alpha \tag{6}$$

From the equations (5) and (6), the relationship will be established.

$$\begin{aligned} r'\cos\S &= \dot{a}_r \cdot \dot{r}' \\ &= y'\sin\theta\sin\phi\sin\alpha + z'\cos\theta\cos\alpha \end{aligned} \tag{7}$$

The electric field $\dot{E}$ and magnetic field $\dot{H}$ are shown as follows by the term of the electric vector potential $\dot{A}$.

$$\dot{H} = \frac{1}{\mu}\nabla \times \dot{A} \tag{8a}$$

-continued $$\dot{E} = -j\omega\left[\dot{A} + \frac{1}{k^2}\nabla(\ \cdot \dot{A})\right] \tag{8b}$$

where $\omega$ is the angular frequency and $\nabla$ denotes a del operator, which is represented by:

$$\nabla = \dot{a}_r\frac{\partial}{\partial r} + \dot{a}_\theta\frac{1}{r}\ \frac{\partial}{\partial\theta} + \dot{a}_\phi\frac{1}{r\sin\theta}\ \frac{\partial}{\partial\phi} \tag{9}$$

$\dot{a}_r$, $\dot{a}_\theta$ and $\dot{a}_\phi$ are respectively unit vectors in the directions of r, $\theta$ and $\phi$.

In this case, when the observation point is set at an infinite distance, $\nabla \times \dot{A}$ may be represented in a simple form as follows.

$$\nabla \times \dot{A} = -\dot{a}_\theta\frac{\partial A_\phi}{\partial r} + \dot{a}_\phi\frac{\partial A_\theta}{\partial r} \tag{10}$$

Therefore, the equation (8a) may be transformed as in the following equations.

$$H_\theta = \frac{jke^{-jkr}}{4\pi r}N_\phi \tag{11a}$$

$$H_\phi = \frac{-jke^{-jkr}}{4\pi r}N_\theta \tag{11b}$$

Here, on the assumption of plane waves for the waves of far field, these will be obtained by:

$$E_\theta = Z_0H_\phi \tag{12a}$$

$$E_\phi = -Z_0H_\theta \tag{12b}$$

where $Z_0$ is the intrinsic impedance in air normally represented as $120\pi$. Therefore, from the equations (11) and (12); following relationships are derived:

$$E_\theta = \frac{-jke^{-jkr}}{4\pi r}Z_0N_\theta = -j30k\frac{e^{-jkr}}{r}N_\theta \tag{13a}$$

$$E_\phi = \frac{-jke^{-jkr}}{4\pi r}Z_0N_\phi = -j30k\frac{e^{-jkr}}{r}N_\phi \tag{13b}$$

and upon substitution of the above into the equation (1), the result taking into account the image strip conductor may be obtained, but the conditions for the circularly polarized radiation can be derived by the use only of the equation (13), wherein the numerals (13a) and (13b) are designated as (13), which is applicable to the text belows. Accordingly, $\theta$ and $\phi$ components of the radiation vectors in the equation (13) will be obtained from the rectangular coordinate component through the employment of the following relationships.

$$N_\theta = N_y\cos\theta\sin\phi - N_z\sin\theta \tag{14a}$$

$$N_\phi = N_y\cos\phi \tag{14b}$$

Therefore, upon deriving of radiation vectors $N_z$ and $N_y$, the conditions for the circularly polarized radiation may be obtained therefrom.

Subsequently, the radiation vector, and consequently, the electric field of the crank type fundamental element will be obtained. It is to be noted, however, that only the case where $\phi=0$, i.e. only the radiation vector in the ZX-plane, will be dealt with.

Figure 5:
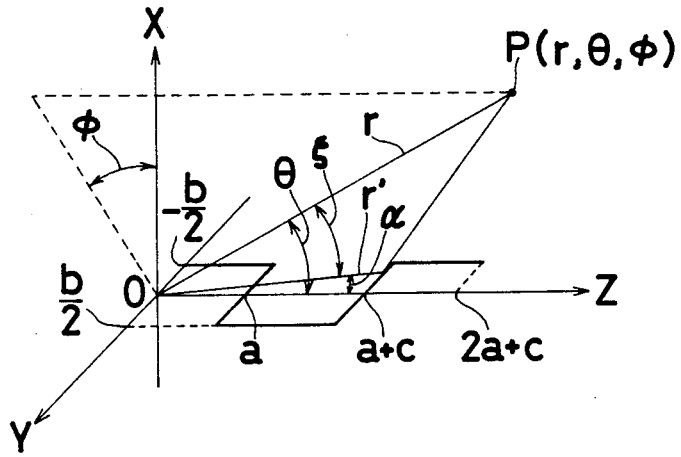
FIG. 5 is a diagram showing the strip conductor and co-ordinate system thereof.
Figure 6:
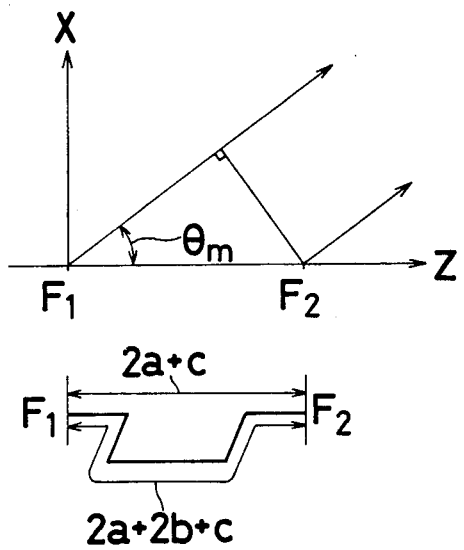
FIG. 6 is a reference diagram for obtaining the main beam direction.

Now, on the assumption that the current density is represented by $J_0e^{-j\beta\xi}$, where $\beta=2\pi/\lambda g$, $\lambda g$ denotes the guide wavelength and $\xi$ is the distance variable, $N_z$ and $N_y$ are represented by the following equations based on the equation (3) with reference to FIG. 5.

$$\begin{aligned}
N_z &= \int_O^a J_0e^{-j(\beta-k\cos\theta)Z}\,dz + \int_a^{a+c} J_0e^{-j\beta b-j(\beta-k\cos\theta)Z}\,dz + \int_{a+c}^{2a+c} J_0e^{-j2\beta b-j(\beta-k\cos\theta)Z}\,dz \\
&= \frac{2J_0\sin(\beta-k\cos\theta)\frac{a}{2}}{\beta-k\cos\theta}e^{-j(\beta-k\cos\theta)\frac{a}{2}} + \frac{2J_0\sin(\beta-k\cos\theta)\frac{c}{2}}{\beta-k\cos\theta}e^{-j\beta b-j(\beta-k\cos\theta)(a+\frac{c}{2})} + \frac{2J_0\sin(\beta-k\cos\theta)\frac{a}{2}}{\beta-k\cos\theta}e^{-j2\beta b-j(\beta-k\cos\theta)(\frac{3}{2}a+c)} \\
&= \frac{2J_0}{\beta-k\cos\theta}e^{-j\beta b-j(\beta-k\cos\theta)(a+\frac{c}{2})}\times\left\{\sin(\beta-k\cos\theta)\frac{a}{2}e^{j\beta b+j(\beta-k\cos\theta)\frac{a+c}{2}} + \sin(\beta-k\cos\theta)\frac{c}{2} + \sin(\beta-k\cos\theta)\frac{a}{2}e^{-j\beta b-(\beta-k\cos\theta)\frac{a+c}{2}}\right\} \\
&= \frac{2J_0}{\beta-k\cos\theta}e^{-j\beta b-j(\beta-k\cos\theta)(a+\frac{c}{2})}\left[\sin(\beta-k\cos\theta)\frac{c}{2} + \sin(\beta-k\cos\theta)\frac{a}{2}\cdot 2\cos\left\{\beta b+(\beta-k\cos\theta)\frac{a+c}{2}\right\}\right] \\
&= \frac{2J_0}{\beta-k\cos\theta}e^{-j\beta b-j(\beta-k\cos\theta)(a+\frac{c}{2})}\cdot\left[\sin\left\{\beta b+(\beta-k\cos\theta)\left(a+\frac{c}{2}\right)\right\} - 2\sin\left(\frac{\beta b}{2}\right)\cdot\cos\left\{\frac{\beta b+(\beta-k\cos\theta)c}{2}\right\}\right]
\end{aligned} \tag{15a}$$

$$\begin{aligned}
N_y &= \int_{-\frac{b}{2}}^{\frac{b}{2}} J_0e^{-j\beta(\frac{b}{2}+y)-j(\beta-k\cos\theta)a}\,dy + \int_{\frac{b}{2}}^{-\frac{b}{2}} J_0e^{-j\beta(\frac{3}{2}b+y)-j(\beta-k\cos\theta)(a+c)}\,dy \\
&= \frac{2J_0\sin\left(\frac{\beta b}{2}\right)}{\beta}e^{-j\frac{\beta b}{2}-j(\beta-k\cos\theta)a} -
\end{aligned} \tag{15b}$$

-continued $$\frac{2J_0\sin\left(\frac{\beta b}{2}\right)}{\beta} e^{-j\frac{3}{2}\beta b - j(\beta - k\cos\theta)(a+c)}$$

$$= \frac{2J_0\sin\left(\frac{\beta b}{2}\right)}{\beta} e^{-j\beta b - j(\beta - k\cos\theta)(a+\frac{c}{2})} \times$$

$$\left\{ e^{j\frac{\beta b}{2} + j(\beta - k\cos\theta)\frac{c}{2}} - e^{-j\frac{\beta b}{2} - j(\beta - k\cos\theta)\frac{c}{2}} \right\}$$

$$= j\frac{4J_0\sin\left(\frac{\beta b}{2}\right)}{\beta} \cdot \sin\left\{ \frac{\beta b}{2} + (\beta - k\cos\theta)\frac{c}{2} \right\} \cdot$$

$$e^{-j\beta b - j(\beta - k\cos\theta)(a+\frac{c}{2})}$$

In the relationship $\phi=0$, if the equation (14) is employed, the equation (15) may be represented by the equations as follows.

$$N_\theta = -N\sin\theta$$

$$= \frac{-2J_0\sin\theta}{\beta - k\cos\theta}\left[\sin\left\{\beta b + (\beta - k\cos\theta)\left(a + \frac{c}{2}\right)\right\} - 2\sin\left(\frac{\beta b}{2}\right) \cdot \cos\left\{\frac{\beta b + (\beta - k\cos\theta)c}{2}\right\}\right] e^{-j\gamma} \quad (16a)$$

$$N_\phi = N_y$$

$$= j\frac{4J_0\sin\left(\frac{\beta b}{2}\right)}{\beta} \sin\left\{\frac{\beta b + (\beta - k\cos\theta)c}{2}\right\} e^{-j\gamma} \quad (16b)$$

$$\gamma = \beta b + (\beta - k\cos\theta)\left(a + \frac{c}{2}\right) \quad (16c)$$

In the above equations, there is a phase difference of $\pi/2$ between $N_\theta$ and $N_\phi$, and therefore, the conditions for the circularly polarized radiation in the direction $\theta=\theta m$ can be obtained by $$|N_\theta| = |N_\phi| \quad (17)$$

Therefore, from the equations (16) and (17), the radiation as follows will be established.

$$\frac{-\sin\theta_m}{\beta - k\cos\theta_m}\left[\sin\left\{\beta b + (\beta - k\cos\theta_m)\left(a + \frac{c}{2}\right)\right\} - 2\sin\left(\frac{\beta b}{2}\right)\cos\left\{\frac{\beta b + (\beta - k\cos\theta_m)c}{2}\right\}\right] = \pm\frac{2}{\beta}\sin\left(\frac{\beta b}{2}\right)\sin\left\{\frac{\beta b + (\beta - k\cos\theta_m)c}{2}\right\} \quad (18)$$

In the next step, the conditions for forming the main beam in the direction $\theta=\theta m$ and $\phi=0$, by constituting an array antenna through periodical connections of the crank type fundamental elements, i.e. the conditions under which the phases of the waves radiated from the starting point $F_1$ and terminating point of $F_2$ of the crank type fundamental element become to be in phase in the $\theta m$ direction, will be represented by:

$$k(2a + c)\cos\theta_m - \beta(2a + 2b + c) = 2n\pi \quad (19a)$$

$n$: integer $$\text{or } \beta b + (\beta - k\cos\theta_m)\left(a + \frac{c}{2}\right) = -n\pi \quad (19b)$$

Upon substitution of the equation (19b) into the equation (18), the relationship will be:

$$\frac{\sin\theta_m}{\beta - k\cos\theta_m}\sin\left(\frac{\beta b}{2}\right) \cdot \cos\left\{\frac{\beta b + (\beta - k\cos\theta_m)c}{2}\right\} = \pm\frac{1}{\beta}\sin\left(\frac{\beta b}{2}\right)\sin\left\{\frac{\beta b + (\beta - k\cos\theta_m)c}{2}\right\} \quad (20a)$$

and on the supposition that $\sin(\beta b/2)\neq 0$, the above equation will be shown as:

$$\tan\left\{\frac{\beta b + (\beta - k\cos\theta_m)c}{2}\right\} = \pm\frac{\beta\sin\theta_m}{\beta - k\cos\theta_m} \quad (20b)$$

Upon transformation, the equation (20b) will be represented as:

$$b + (1 - \eta\cos\theta_m)c = \lambda g\left\{m \pm \frac{1}{\pi}\mathrm{Tan}^{-1}\left(\frac{\sin\theta_m}{1 - \eta\cos\theta_m}\right)\right\} \quad (21)$$

where $\eta=k/\beta=\lambda g/\lambda_0$ and m is an integer. From the equations (19b) and (21), the equation as follows can be obtained.

$$b + (1 - \eta\cos\theta_m)2a = -\lambda g\left\{m + n \pm \frac{1}{\pi}\mathrm{Tan}^{-1}\left(\frac{\sin\theta_m}{1 - \eta\cos\theta_m}\right)\right\} \quad (22)$$

With respect to the equations (21) and (22), if b is given, a and c may be obtained for the proper combination of m and n. In other words, the dimensional value for each side of the crank type fundamental element can be obtained. It is to be noted that, of the $\pm$, $\mp$ signs in both of the equations, the upper sign shows the case for the left-hand circularly polarized wave, while the lower sign relates to the case for the right-hand circularly polarized wave.

In equations (21) and (22), the combination of $m=1$ and $n=-2$ is best suited with respect to the construction of the crank type fundamental element. Therefore, the relationships will be:

$$b + (1 - \eta\cos\theta_m)2a = \lambda g\left\{1 \mp \frac{1}{\pi}\mathrm{Tan}^{-1}\left(\frac{\sin\theta_m}{1 - \eta\cos\theta_m}\right)\right\} \quad (23a)$$

-continued $$b + (1 - \eta\cos\theta_m)c = \lambda g\left\{1 \pm \frac{1}{\pi}\,\mathrm{Tan}^{-1}\left(\frac{\sin\theta_m}{1 - \eta\cos\theta_m}\right)\right\} \tag{23b}$$

Accordingly, in the above equations, if a proper value for b is given, values for a and c will be determined, and thus, the configuration of the crank type fundamental element for radiating the circularly polarized wave in the $\theta$m direction can be determined. In this case, it is seen that the radiation vectors $|N\theta|$ and $|N\phi|$ of the crank type fundamental element are proportional to sin ($\beta$b/2) from the equations (16) and (19b). Now, since the maximum value of sin ($\beta$b/2) is 1, the value for $b=\lambda g/2$ becomes the maximum from the relationship sin ($\beta$b/2)=1. Accordingly, the value b may be selected as desired in the range $(\lambda g/2) \geqq b > 0$. However, it has been found that an optimum value for b is equal to $3\lambda_g/8$.

Furthermore, as a specific example, the case in which $\theta m=\pi/2$ will be explained in detail hereinbelow. More specifically, in the case of broad-side radiation, the equation (23) will simply be represented as follows.

$$\text{Upper Sign}\begin{cases} b + 2a = \frac{3}{4}\lambda g \\ b + c = \frac{5}{4}\lambda g \end{cases} \tag{24a}$$

$$\text{Lower Sign}\begin{cases} b + 2a = \frac{5}{4}\lambda g \\ b + c = \frac{3}{4}\lambda g \end{cases} \tag{24b}$$

where the upper sign denotes the conditional equation for radiating the left-hand circularly polarized wave, while the lower sign represents that for radiating the right-hand circularly polarized wave. The description will be given hereinbelow with reference to the case for the right-hand circularly polarized wave. From the equation (24b), the relationship will be represented as:

$$a = \frac{1}{2}\left(\frac{5}{4}\lambda g - b\right) \tag{25a}$$

$$c = \frac{3}{4}\lambda g - b \tag{25b}$$

and if the value b is given in the above equations, values for a and c can be determined. It should be noted here, however, that, although constitution is possible within the range $3\lambda g/4 > b > 0$ physically, the value for b should preferably be selected to be less than $\lambda g/2$. From the equation (25), the relationship as follows: may be obtained:

$$2a + 2b + c = 2\lambda g \tag{26a}$$

$$2a - c = \frac{\lambda g}{2} \tag{26b}$$

but what is meant by the above equations are such that it is essential conditions for the circularly polarized radiation in the broadside direction to select the line length $l=2a+2b+c$ of the crank type fundamental element, at $2\lambda g$, and to set the length for $2a-c$ at $\lambda g/2$.

Subsequently, principle of operation for the above described crank type fundamental element to radiate the circularly polarized wave will be described with reference to the case of $\theta m=\pi/2$, $\phi=0$ and $b=\lambda g/4$ as an example. In the above case, various factors will be determined as follows upon employment of the equation (25).

$$a = \frac{\lambda g}{2},\ b = \frac{\lambda g}{4},\ c = \frac{\lambda g}{2} \tag{27}$$

$$l = 2a + 2b + c = 2\lambda g,\ L = 2a + c = \frac{3}{2}g$$

Figure 7:
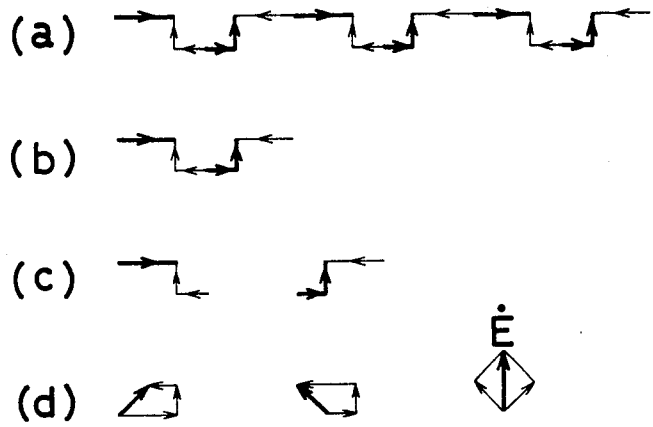
FIGS. 7 and 8 are diagrams which illustrate instantaneous currents on the strip conductors in the embodiment of FIG. 2 for showing the state of generation of circularly polarized waves.
Figure 8:
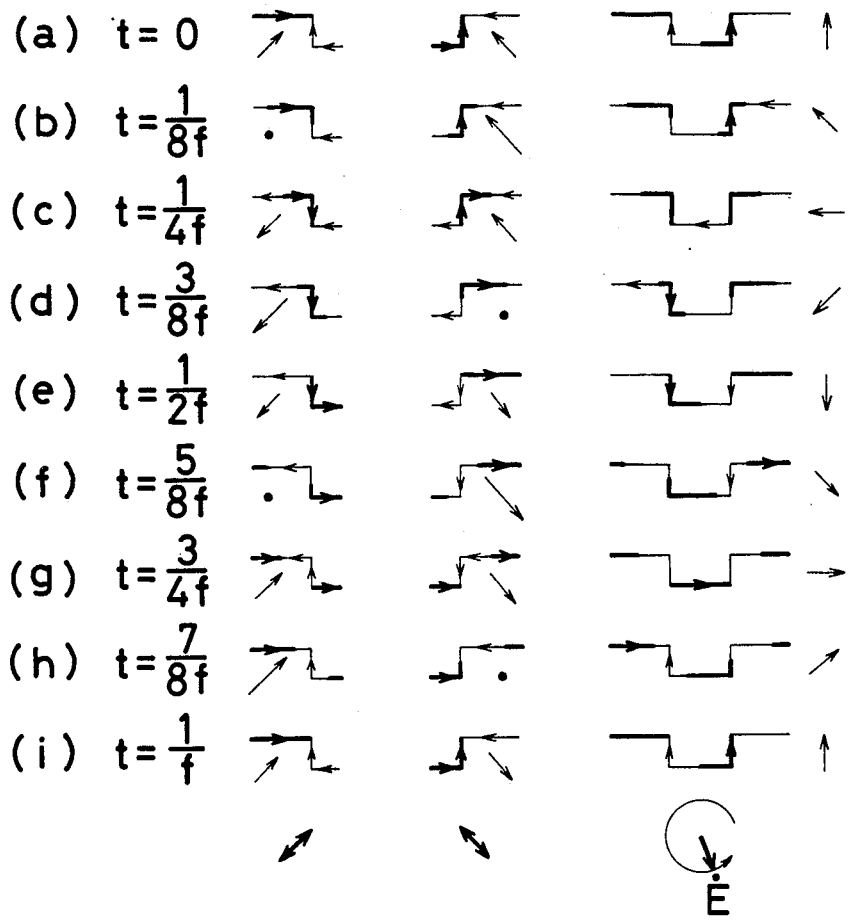

Although the microstrip line antenna of the above described kind is arranged to function as a travelling-wave antenna by periodically folding or bending the strip conductor, description will be made hereinbelow, with the current which flows through the strip conductor being regarded as a source of radiation in the equivalent manner. Now, upon feeding of high frequency current to the strip conductor constituted by the straight portions and U-shaped portions as described earlier from the feed point F shown in FIG. 2, the direction of the current flowing through each of the conducting pieces is reversed at every $\lambda g/2$ if represented with respect to a certain instant, the state of which is shown by thick lines and thin lines together with arrows in FIG. 7(*a*), while FIG. 7(*b*) illustrates only the configuration of the crank type fundamental element. This crank type fundamental element is divided into two step shapes for linear symmetrical relation as shown in FIG. 7(*c*). The microstrip line antenna radiates electromagnetic waves directed in the same direction as that of the high frequency current on the strip conductor, and proportional, in magnitude, to said high frequency current. Accordingly, the resultant field $\dot{E}$ of the electromagnetic waves radiated from respective sides of the conductors in the step configuration is directed in the direction as shown in FIG. 7(*d*) at a certain time t=0 upon observation at the infinite distance in the broadside direction represented by $\theta=\pi/2$ and $\phi=0$. This may be considered as the composition of two linear polarized wave components radiated from two step configuration radiating elements, and intersecting at right angles to each other. The state at a certain time t=0 is again shown in FIG. 8(*a*). Subsequently, the direction of the instantaneous current after lapse of time t by (1/8f) is given in FIG. 8(*b*), where f represents the frequency of the high frequency current to be employed. In this case, the resultant field $\dot{E}$ is rotating in the counterclockwise direction when observed facing the antenna (in the -X direction) as shown in the figure. FIGS. 8(*c*) to 8(*i*) show cases for further lapse of time, and after all, the resultant field $\dot{E}$ of the electromagnetic wave radiated from the crank type fundamental element rotates in the counterclockwise direction with the lapse of time as observed facing the antenna so as to complete one rotation in the time 1/f i.e. in one period. In this case, the resultant field vector E as shown in FIG. 8 has a constant magnitude, and rotates uniformly with respect to time in the direction $\theta=\pi/2$ and $\phi=0$, i.e. in the broadside direction, at a rotational speed of one rotation per each cycle. In FIG. 8, it is shown that the two step shaped radiating elements are respectively linear polarized radiating elements intersecting at right angles to each other with the lapse of time, while there is a phase difference of 90° therebetween in terms of time. Now, in the case where field amplitudes of the both are equal to each other, it is indicated that the resultant wave thereof is of the circularly polarized wave. Accordingly, the electromagnetic wave radiated from the zigzag shaped strip conductor 6 is in the form of the right-hand circularly polarized wave with time. In the above case, since the strip conductor length l of the crank type fundamental element is $2\lambda g$, the circularly polarized waves radiated from the respective crank type fundamental elements are in phase in the broadside direction for addition to each other therebetween. Accordingly, the antenna 10 as shown in FIG. 2 may be regarded as constituting a linear array antenna in which the crank type fundamental elements are subjected to series feeding. It should be noted here that, although the foregoing description is given with reference to a transmission antenna, the antenna may function as a circularly polarized receiving antenna as well.

In the next step, description will be given on the relationship between the working frequency f and the main beam direction $\theta m$, which relation has already been shown by the equation (19a). Upon representation of the equation (19a) by the employment of $L=2a+c$, $l=2a+2b+c$ and $n=-2$, the relationship will be given by the equations as follows:

$$kL\cos\theta_m - \beta l = -4\pi \tag{28}$$

$$\therefore \cos\theta_m = \frac{1}{kL}(\beta l - 4\pi) = \frac{l}{\eta L} - \frac{2\lambda_0}{L} = \frac{l}{\eta L} - \frac{2v}{Lf}$$

where l and L are respectively the strip conductor length and periodical length of the crank type fundamental elements as shown in FIG. 2, and v is the velocity of light. What is meant by the equation (28) is that the main beam direction varies with the variation of frequency, and the above relationship, if converted into specific scanning sensitivity, will be represented by the following equation.

$$Q = \frac{d\theta_m}{df/f} = -\frac{2v}{f\sin\theta_m}\cdot\frac{1}{L} \tag{29}$$

The above equation indicates that, the absolute value of Q is rendered small as the value of the strip conductor periodical length L becomes large, and therefore implies that the scanning of the main beam is small with respect to the frequency variation as the periodical length L becomes large.

Figure 9:
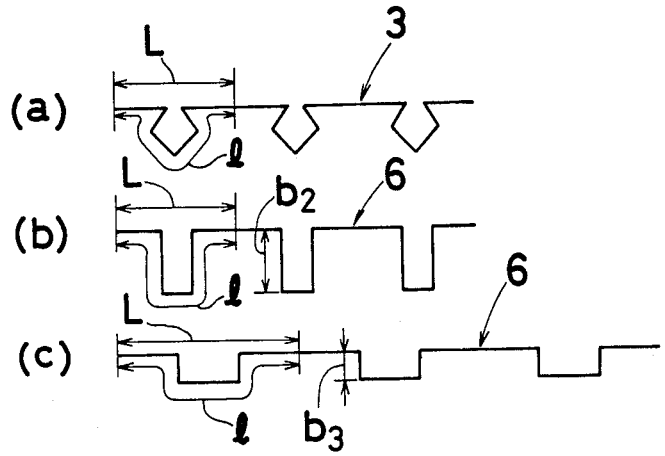
FIG. 9 shows diagrams explanatory of the difference between the conventional antenna construction (a) and constructions of the antennas (b) and (c) according to the embodiments of the present invention.

Upon comparison of the conventional circularly polarized microstrip line antenna as shown in FIG. 9(*a*) with the antenna 10 according to the present invention as shown in FIGS. 9(*b*) and 9(*c*), it is seen that, with respect to the same strip conductor length l, depending on the selection of the value for the U-shaped arm length b, the periodical length L of the strip conductor may be taken over the range from the minimum $\lambda g$ to less than $2\lambda g$ at the maximum.

Therefore, it is shown that, in the antenna 10 according to one preferred embodiment of designs of the present invention, the specific scanning sensitivity Q is reduced to about 1 to 0.5 times, and for application to transmission and reception in one constant direction, the frequency bandwidth is broadened to about 1 to 2 times for improvement. However, as stated earlier, the radiation intensity from the crank type fundamental element is proportional to sin ($\beta b/2$), and if the value for b is excessively small, the radiation will be too slight to be realistic, and therefore, suitable range for the value b will be approximately in the relationship $\lambda g/2 \geqq b \geqq \lambda g/5$, with the frequency bandwidth broader by about 1 to 1.6 times being obtainable.

As stated in the foregoing, there is an advantage that the smaller the value selected for b, the broader is the frequency bandwidth, but there will also be a possibility that a new drawback may be introduced, for example, in the case where $L=2a+c>\lambda_0$. More specifically, when the periodical length L of the strip conductor becomes larger than the free space wavelength $\lambda_0$, there may arise such an inconvenience that, the grating lobe is developed to deteriorate the characteristics as an antenna.

By way of example, with the employment of a microstrip line, for example, having the effective wavelength reduction rate $\eta=\lambda g/\lambda_0=0.68$, when $b=\lambda g/4$, the relationship will be represented by:

$$L=1.5\lambda g=1.5\times 0.68\lambda_0=1.02\lambda_0>\lambda_0 \tag{30}$$

and the grating lobe appears in the vicinity of the longitudinal direction of the dielectric substrate 4.

Figure 10:
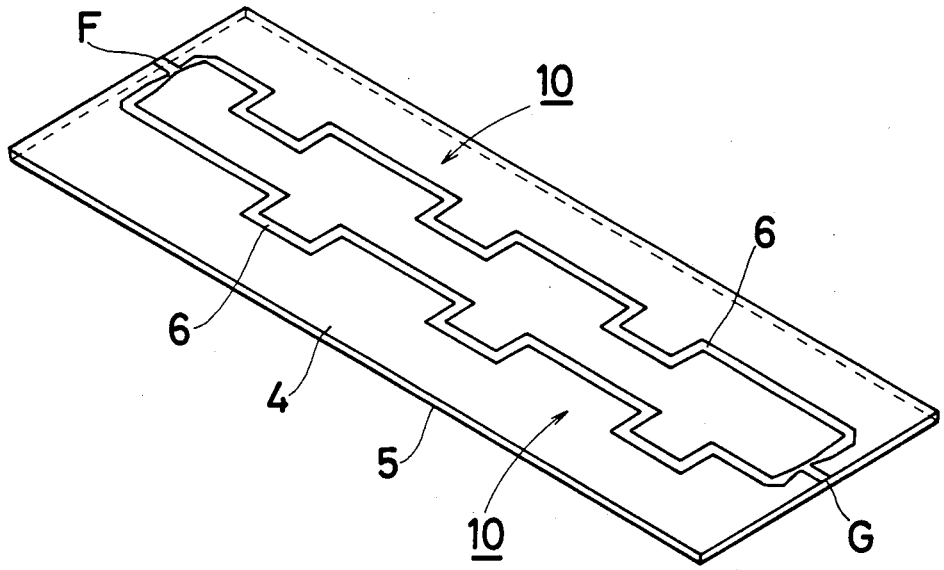
FIG. 10 is a perspective view showing another embodiment according to the present invention.

Generally, as a system for canceling the grating lobe for the linear array antenna, there is employed a method in which, by simultaneously arranging two similar array antennas in the same plane, the positions thereof are deviated by half periodical length to dispose the radiating elements in the so-called triangular arrangment. Since the above system can be applied to the present invention, it has been utilized therefor as shown in the embodiment of FIG. 10. When the factors as shown in the equation (27) are employed, the selection of the dimensions thereof is given in FIG. 11. In other words, the embodiment of FIG. 10 is so arranged that in the circularly polarized microstrip line antenna 10 according to the first embodiment described earlier, the U-shaped portions are directed in parallel in the same direction, with said U-shaped portions being deviated in positions by $(\frac{3}{4})\lambda g$.

Figure 11:
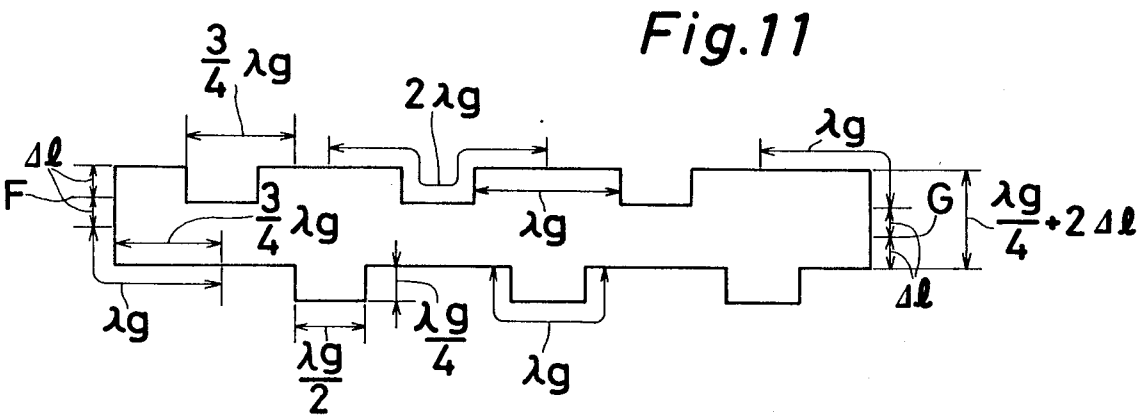
FIG. 11 is a diagram explanatory of the selection of dimensions in the embodiment of FIG. 10.
Figure 12:
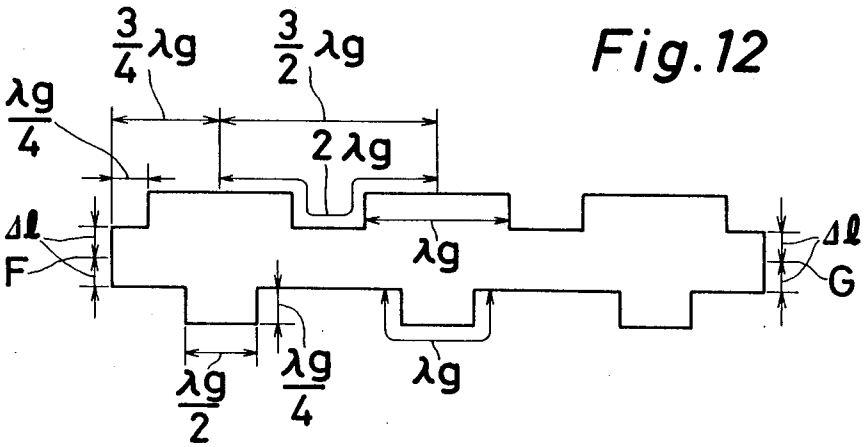
FIG. 12 is a diagram explanatory of the selection of dimensions in another embodiment of the present invention.

It should be noted here that, in FIG. 10, narrow portions in the tapered configuration formed at the feeding point F and terminal end G have for their object to compensate for (i.e. to increase) the reduction of line impedance to ($\frac{1}{2}$) arising from the parallel connections. It should also be noted that, in FIG. 11, the length $\Delta l$ is arbitrary in general for setting the interval between the strip conductors 6,6, and that through proper selection of the value $\Delta l$, variations may be imparted to the characteristics. It is needless to say, however, that the value should be selected to represent the most suitable length. FIG. 12 is another embodiment of the present invention showing an equal characteristics as the embodiment represented in FIG. 11.

In the circularly polarized microstrip line antenna having the construction as described above, the electric fields equivalent to the grating lobe come to have phases opposite to each other so as to be offset, with the result that the grating lobe is suppressed while the electric fields at $\phi=0°$ and $\theta=90°$ are added in a superposed manner to provide only a single directivity.

Figure 13:
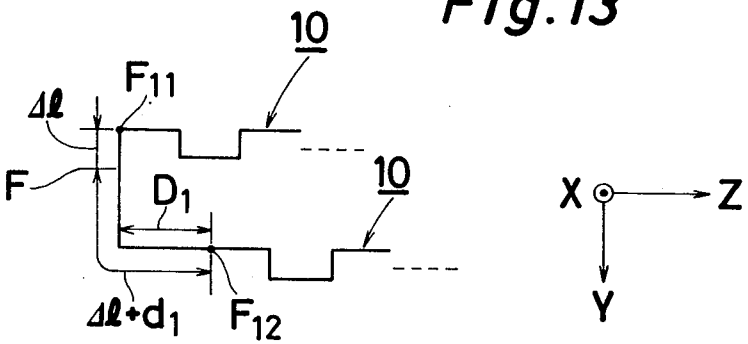
FIG. 13 is a diagram explanatory showing a construction of a microstrip line antenna for canceling a grating lobe according to the embodiment of the present invention.

Conditions for canceling the grating lobe will be given according to the following method. Two microstrip line antennas 10 having an equal construction are arranged in parallel with each other, with a portion of a starting point $F_{12}$ being deviated from a position of starting point $F_{11}$ of the other antenna by $D_1$ as shown in FIG. 13. The difference between the length from a feed point F to the starting point $F_{11}$ and the length from a feed point F to the starting point $F_{12}$ will be referred to as $d_1$. At this time, in the direction represented by $\phi=0$ and $\theta=\theta m$, the condition that the electric waves radiated from the starting points $F_{11}$ and $F_{12}$ are in phase is as follows:

$$kD_1 \cos \theta_m - \beta d_1 = 2M\pi \quad (31)$$

M: integer

While in the direction represented by $\theta_m$, the condition that the microstrip line antenna 10 forms the main beam is already represented in the equation (19a).

$$kL \cos \theta_m - \beta l = 2n\pi \quad (32)$$

n: integer wherein, $L=2a+c$, $l=2a+2b+c$

When both equation (31) and (32) are satisfied, n mode beam equals to the main beam. Accordingly, the following equation is obtained from the both equations (31) and (32).

$$D_1(\beta l+2n\pi)=L(\beta d_1+2M\pi) \quad (33)$$

While in the direction represented by $\theta=\theta g$, the condition that the (n−1) mode beam equals to the grating lobe is represented by the following equation which is obtained from the equation (19a).

$$kL \cos \theta g = \beta l = 2(n-1)\pi \quad (34)$$

For canceling the grating lobe in the direction represented by $\theta=\theta g$, it is required that the electric waves radiated from the starting point $F_{11}$ and the starting point $F_{12}$ are out of phase. Therefore, the following equation is obtained.

$$kD_1 \cos \theta g - \beta d_1 = (2M-1)\pi \quad (35)$$

Accordingly, it is required to satisfy the both equations (34) and (35) for canceling the (n−1) mode beam, namely, the grating lobe. Therefore, the following equation is obtained.

$$D_1\{\beta l+2(n-1)\pi\}=L\{\beta d_1+(2M-1)\pi\} \quad (36)$$

Therefore, when all of the equations (31), (32), (34) and (35) are satisfied, the microstrip line antenna has a mono directional beam. According to the equations (33) and (36), the following equations are obtained.

$$D_1=(L/2) \quad (37a)$$

$$d_1=(l/2)+((n/2)-M)\lambda g \quad (37b)$$

For example, the various factors represented in the equation (27) being employed, the following equations are obtained, $$D_1=(L/2)=\tfrac{3}{2}\lambda g \quad (38a)$$

$$d_1=(l/2)=\lambda g \quad (38b)$$

since n=−2, M=−1 when $d_1>0$ and $d_1$ is chosen to be the shortest. Therefore, the dimensions are selected as shown in FIG. 11. The equation (37) is also satisfactory for the (n+1) mode beam.

When the main beam direction is not the direction normal to the surface of the substrate, namely $\phi\neq 90°$ the periodical length L becomes still longer than the free space wavelength $\lambda_0$, and there is an occasion that a (n−2) mode beam may exist in the direction represented by $\theta=\theta gg$ as well as the (n−1) mode beam in the direction represented by $\theta=\theta g$. On such an occasion, the (n−1) mode beam will be canceled by combining two rows of the antennas as mentioned above. Furthermore, when the two rows of the antennas are recognized as a single antenna, the (n−2) mode beam is canceled by combining a pair of two rows of the antennas in parallel, namely, by employing four antennas. In equation (34), when (n−1) is replaced by (n−2), the following equations are obtained.

$$D_2=(L/4) \quad (39a)$$

$$d_2=(l/4)+((n/4)-M)\lambda g \quad (39b)$$

For example, when various factors are chosen as follows; $\phi=0$, $\theta_m=45°$ and $b=0.46\lambda g$, the following equations are obtained from the equation (23).

$$l=2a+2b+c=3\lambda g \quad (40a)$$

$$L=2a+c=2.08\lambda g \quad (40b)$$

At this time, the (n−1) mode beam appears in the direction represented by $\theta g=90°$ and the (n−2) mode beam appears in the direction represented by $\theta g=135°$ as the grating lobes. Since n=−2, M=0 when $d>0$ and $d_2$ is the shortest, the following equations are obtained.

$$D_2=(L/4)=0.52\lambda g \quad (41a)$$

$$d_2=(l/4)-\lambda g/2=0.25\lambda g \quad (41b)$$

Also, the following equations are obtained from the equation (37).

$$D_1=(L/2)=1.04\lambda g \quad (42a)$$

$$d_1=(l/2)=1.5\lambda g \quad (42b)$$

Figure 14:
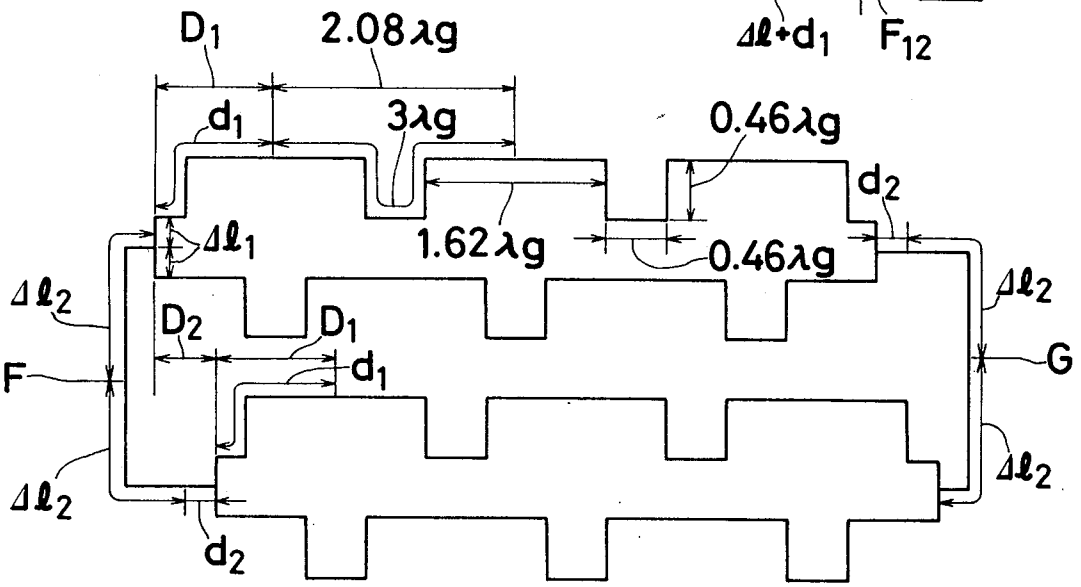
FIG. 14 is a diagram explanatory of an antenna construction for canceling a grating lobe.

An example for cancaling the grating lobes are shown in FIG. 14, which is the application of the embodiment combining pairs of two rows of antennas as shown in FIG. 12.

Figure 15:
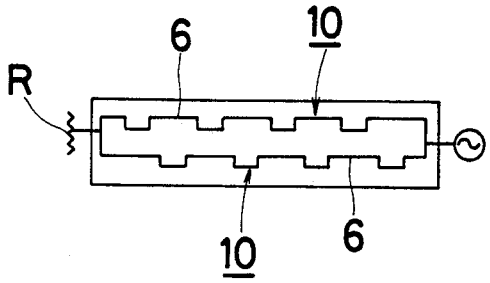
FIG. 15 through FIG. 20 are diagrams respectively showing various constructions of stip conductors for other embodiments according to the present invention.
Figure 16:
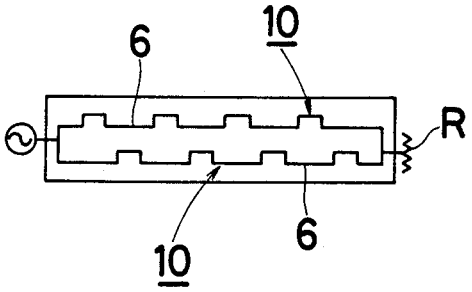
Figure 17:
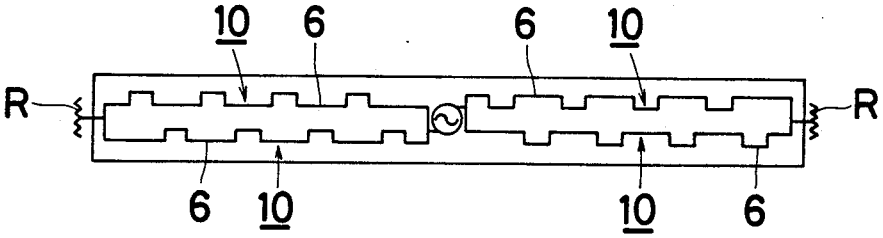

It is to be noted here that, although the foregoing description is entirely related to the transmission antenna of right-hand circularly polarized wave, a transmission and reception antenna for the left-hand circularly polarized wave may be constituted in the case where the feeding direction of the microstrip line antenna is reversed as shown in FIG. 15, or if the direction of the U-shaped portions is reversed by combining two rows of the antenna 10, with positional deviation by (L/2) therebetween as shown in FIG. 16. Additionally, it may be so modified that, as shown in FIG. 17, a pair of microstrip line antennas 10 are arranged side by side in a point symmetrical relation, with the feed point being set as an approximate center for feeding (or reception) from the central portion.

Besides the above arrangements, the present invention may be effected in the form of planar array antenna in which a plurality of rows of antennas as desired are provided.

Figure 18:
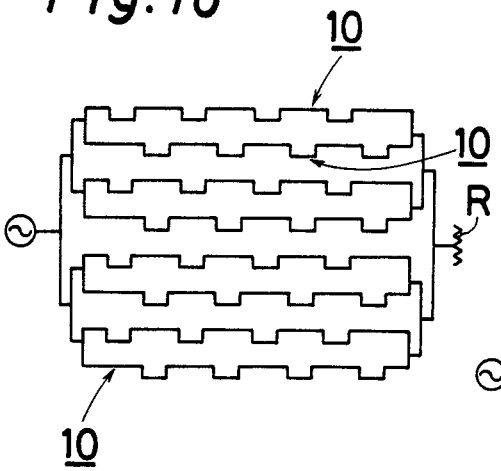
Figure 19:
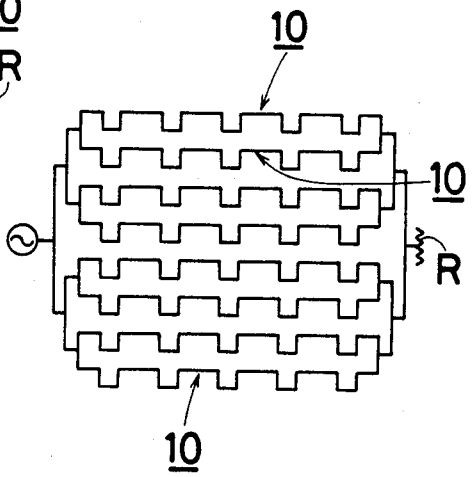
Figure 20:
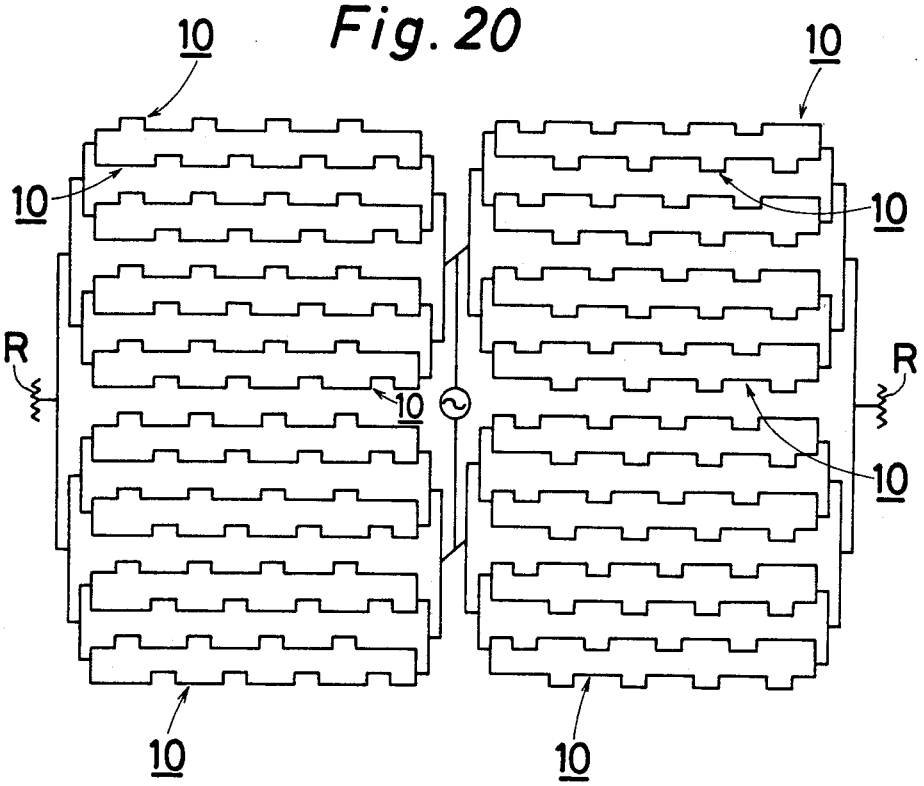

In the modification shown in FIG. 18, microstrip line antennas constituted in the manner of regular arrangement as described so far are arranged in a plurality of rows and in a parallel relationship on the same substrate as illustrated, with one end of the substrate set as the feed point while in FIG. 19, microstrip line antennas constituted in the manner of a triangular arrangement as described so far are arranged in a plurality of rows and in a parallel relationship on the same substrate as illustrated, with one end of the substrate set as the feed point, and in the arrangement of FIG. 20, microstrip line antennas 10 having the construction as described above are provided in pairs at the left and right sides on one plane in a multiple-array configuration for feeding at the central portion. In the foregoing arrangements, it is needless to say that the compensation for the line impedance is effected in the similar manner as in the antenna shown in FIG. 10.

The following result is obtained from the experiment using a microstrip line antenna which has the equal constraction as the embodiment mentioned above, and shown in FIG. 2. Referring to FIG. 3, dimensions of an example is as follows:

All the lengths for the sides are represented by lengths alone the center line.

(a) Substrate material: Rexolite 1422 (Trade name: Oak Co., U.S.A.), Material: Cross-linked polystyrene, Relative dielectric constant: $\epsilon_r=2.53$, Loss factor: tan $\delta=6.6\times10^{-4}$
(b) Substrate thickness: 0.79 mm
(c) Substrate width: 30 cm
(d) Width W of strip conductor 6: 2 mm
(e) Length a of Z direction side A: 10 mm
(f) Length b of Y direction side B: 7 mm
(g) Length c of Z direction side C: 12 mm The diagrams in FIGS. 21 and 22 respectively show the ZX plane radiation field pattern and XY plane radiation field pattern as obtained upon rotation of the plane of polarization of transmission antenna by applying a mechanical or physical force at frequency f=9.3 GHz, with the number of U-shaped conductors for the strip conductor 6 being set to be 6. It is to be noted that, according to the results of actual measurements, favorable circularly polarized wave characteristics are shown with axial ratio in the main beam direction ($\theta=91°$, $\phi=0°$) AR=1.07 (an ellipse extremely approximated to a round circle AR=1). Meanwhile, there have also been obtained observation values such as the gain of 8.5 dBi in the main beam direction, beam widths of 8.0° in the ZX-plane and 75.0° in the XY-plane, and side lobe level in the ZX-plane of −10.3 dB (approximately 0.3 times). Additionally, other various data are as shown below.

(a) Frequency: f=9.3 GHz
(b) Free space wavelength: $\lambda_0=32.25$ mm
(c) Guide wavelength: $\lambda g=21.93$ mm
(Effective wavelength reduction rate $\beta=(\lambda g\lambda_0)=0.68$)
(d) Gain: G=8.5 dBi
(i indicates that the ratio is with respect to an isotropic antenna.)
(e) Gain-beam width product: 4200
(f) VSWR (Voltage Standing Wave Ratio): $\sigma=1.22$
(g) Dissipated power in the load: −5.0 dB (31.6%)
(h) Matched load: R=50Ω

Figure 21:
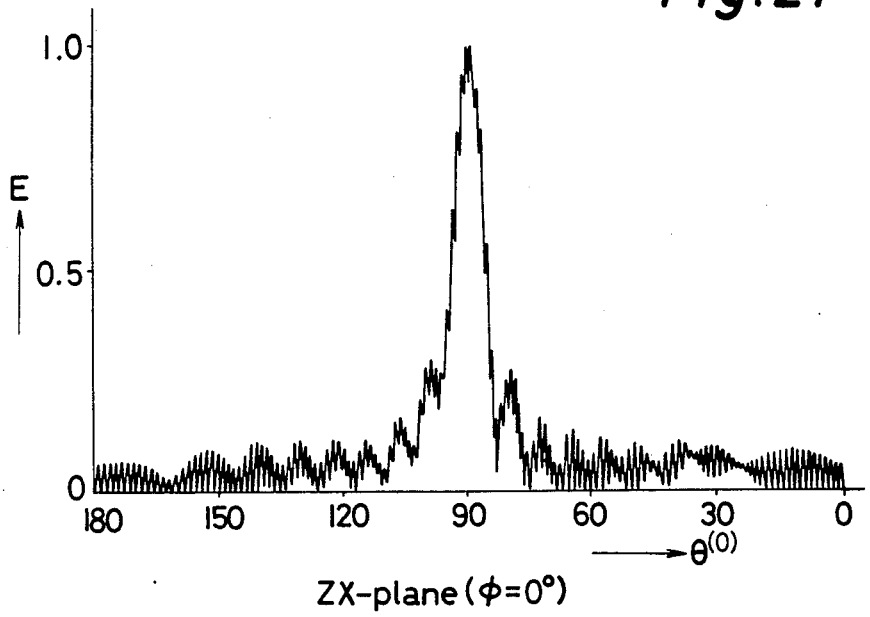
FIG. 21 is a ZX-plane radiation field pattern according to the result of an actual mesurement using a microstrip line antenna represented in FIG. 2.
Figure 22:
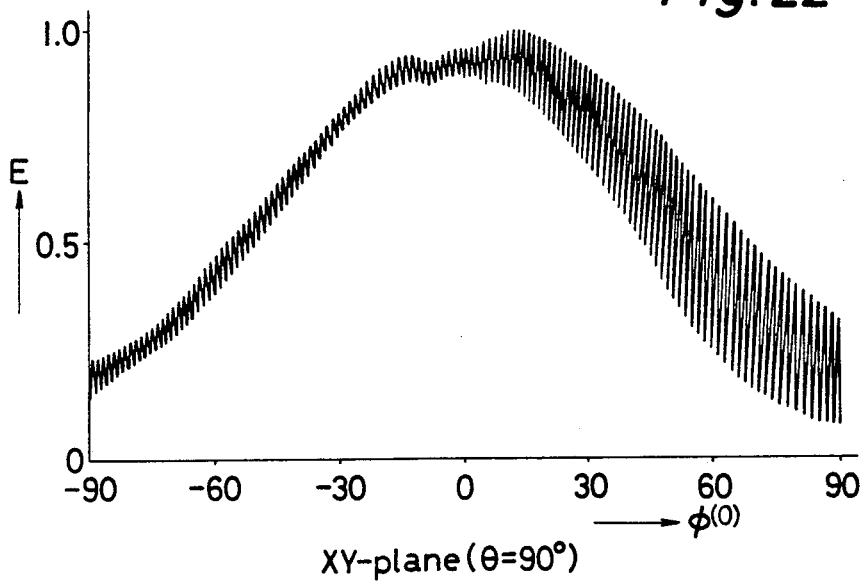
FIG. 22 is a XY-plane radiation field pattern according to the result of actual measurement using a microstrip line antenna as shown in FIG. 2.

Of the observation values as described above, the small value for the gain-beam width product is attributable to the fact that, in the ZX plane radiation field pattern in FIG. 21, grating lobes appears in the vicinity of $\theta=20°$ and 160°.

When "b" in equation (25) is replaced by $\pi g/2$, $3\lambda g/8$ and $\lambda g/4$ respectively, the following relationship is obtained from the experimental results.

Gain: $G_1\approx G_2>G_3$
Frequency band width: $WD_3>WD_2>WD_1$
Axial ratio: $AR_2>AR_1\approx AR_3$ Where $G_1$, $G_2$ and $G_3$ are gain obtained from the replacement of "b" with $\lambda g/2$, $3\lambda g/8$ and $\lambda g/4$ respectively. Also $WD_1$, $WD_2$ and $WD_3$ are frequency bandwidth when "b" is replaced by $\lambda g/2$, $3\lambda g/8$ and $\lambda g/4$ respectively. While $AR_1$, $AR_2$ and $AR_3$ are axial ratio when "b" is replaced by $\lambda g/2$, $3\lambda g/8$ and $\lambda g/4$ respectively.

Accordingly, taking one consideration with another, it is the best condition when "b" is chosen as $3\lambda g/8$.

What is claimed is:

1. A circularly polarized microstrip line antenna wherein there are provided a dielectric substrate having a ground plate formed on one surface thereof and at least one pair of stripline conductors which are bent periodically on the other surface and which are supplied with a travelling-wave, wherein each stripline conductor consists of a plurality of crank type fundamental elements, each element consists of a pair of straight portions each having a length a, and U-shaped portion consisting of a pair of arm pieces each having a length b, and a single base piece having a length c, the straight portions of each stripline conductor are aligned in an imaginary straight line, the elements are aligned so that the U-shaped portions are in a same orientation, these lengths a, b and c are chosen to satisfy the following equations:

$$b=(3\lambda_g/8)$$

where

λg is a guide wavelength, $$2a=[(-n-m\mp T)\lambda g-b]/(1-\eta\cos\theta m)$$

where m and n are integers, $$T=1/\pi\ \mathrm{Tan}^{-1}[\sin\theta m/(1-\eta\cos\theta m)]$$

$$\eta=\lambda g/\lambda_0$$

where

θm is an angle of main beam direction, η is an effective wavelength reduction rate, and $\lambda_0$ is free space wavelength, and $$C=[(m\pm T)\lambda g-b]/(1-\eta\cos\theta m)$$

2. The circularly polarized microstrip line antenna as claimed in claim 1, wherein said at least one pair of stripline conductors are parallel to each other in a plane, the U-shaped portions of the stripline conductors are aligned in parallel to the U-shaped portions of the other stripline conductors and the position of the U-shaped portions deviates from the positions of the U-shaped portions of the other stripline conductor.

3. The circularly polarized microstrip line antenna as claimed in claim 1, wherein a plurality of sets of pairs of stripline conductors are provided, each pair being parallel to every other pair in a plane.

4. The circularly polarized microstrip line antenna as claimed in claim 1, wherein said at least one pair of stripline conductors are arranged side by side in a point symmetrical relationship, with the feed point being set as an approximate center for feeding from the central portion.

5. The circularly polarized microstrip line antenna as claimed in claim 1, wherein a plurality of sets of pairs of stripline conductors are provided in a regular arrangement so that said stripline conductors are arranged in a plurality of rows and in a parallel relationship, with the feed point being set at one end of the substrate.

6. The circularly polarized microstrip line antenna as claimed in claim 5, wherein a plurality of sets of stripline conductors are provided in a plane so as to form a multiple-array configuration with the feed point being set at central position thereof.

* * * * *